United States Patent [19]

Roycraft

[11] 4,078,541

[45] Mar. 14, 1978

[54] WOOD AND OIL BURNING FURNACE

[75] Inventor: Louis H. Roycraft, Longville, Minn.

[73] Assignee: Roycraft Engineering Company, Mansfield, Ohio

[21] Appl. No.: 656,421

[22] Filed: Feb. 9, 1976

[51] Int. Cl.[2] ..... F24H 3/06

[52] U.S. Cl. ..... 126/99 R; 110/260; 126/77; 126/112

[58] Field of Search ..... 126/112, 15 R, 15 A, 126/99 R, 99 D, 77, 146; 110/75 R, 75 B

[56] References Cited

U.S. PATENT DOCUMENTS

| | | | |
|---|---|---|---|
| 804,097 | 11/1905 | Burns | 126/77 |
| 1,279,446 | 9/1918 | Ross, Jr. | 110/75 R X |
| 1,714,649 | 5/1929 | Walouke | 126/112 |
| 1,770,588 | 7/1930 | Cook | 126/15 A |
| 1,834,602 | 12/1931 | Clark | 126/99 R |
| 1,986,581 | 7/1934 | Williams | 110/22 |
| 2,285,108 | 6/1942 | Bryant | 126/99 D |

*Primary Examiner*—William E. Wayner
*Assistant Examiner*—William E. Tapolcai, Jr.
*Attorney, Agent, or Firm*—H. Dale Palmatier

[57] ABSTRACT

A wood and oil burning furnace having a combustion chamber in which logs are laid for burning, a baffle plate across a substantial portion of the top of the combustion chamber, a combustion gas outlet at the top of the chamber, a plurality of secondary air inlet tubes in the upper portion of the combustion chamber, a fan and secondary air preheating chamber in one wall of the combustion chamber and supplying preheated air to such tubes, and oil or gas burner, an auxiliary chamber connected through a port into the combustion chamber and directing the fluid fueled fire into the combustion chamber through the port which is located midway of the length of the sidewall of the combustion chamber.

3 Claims, 4 Drawing Figures

11
12
13
13.1
13.2
12.3
12.11
12.1
14.1
31.1
20
33
33.1
33.2
34
26
25
26.1
26.2
27
28
35
35.1
37
37.1
37.2
38
39.1
21
22
23
23.1
23.2
25.1
30
30.1
30.2
73
L

WOOD AND OIL BURNING FURNACE

BACKGROUND OF THE INVENTION

In numerous localities, substantial quantities of wood and wood scraps are available which may provide an inexpensive source of fuel. A problem has always existed concerning the burning of wood efficiently for heating purposes, and particularly in burning green wood or wood which has not properly dried or been seasoned.

One of the most important problems in regard to burning of wood for space heating purposes relates to the fact that substantially all wood and especially green wood contains a very substantial amount of creosote and moisture along with some volatile gases such as methane. In the burning of wood, the creosote and moisture is driven off the wood by the heat, and in most wood burning devices, oxygen and moisture cause the creosote to solidify on the interior surfaces of the heat exchanger and stack or flue. As time goes by, the quantity of solidified creosote builds up on the interior of the heat exchanger or stack so that less and less heat is transmitted to the space being heated, and a greater and greater risk of chimney fires is created.

The woods which are readily available and inexpensive for use in heating are those which are high in creosote content, and such woods include poplar or aspen, willow, pine, tamarack, cedar, balsam, hemlock and birch.

In some localities sawmill slabs or scrap is readily available and inexpensively obtained, but such material is primarily the outer parts of logs including bark, which is the particular part where a substantial amount of creosotes are found.

In the past, there have been some furnaces or burners which have attempted to burn wood or alternately burn oil in the same firebox or combustion chamber. However, it does not produce efficient burning of the wood or green wood by simply burning oil in the same combustion chamber.

SUMMARY OF THE INVENTION

The present invention produces efficient and complete burning of the combustion gases and volatile materials in the fire chamber of the burner or furnace before such combustion gases are allowed to escape into the heat exchanger and flue. This complete combustion is obtained by injecting secondary combustion air, preferably preheated, above the burning logs in the furnace and causing and using such air to produce a cyclonic action in the combustion chamber so that all of the methane gas and creosote is efficiently burned before the combustion gases are allowed to escape. Such secondary combustion air is injected in an array or curtain of jets directed transversely across the exit port for the combustion gases prior to the entrance of such combustion gases into the heat exchanger and flue. An aspirator tube extends the full length of the combustion chamber to create such jets of air and the aspirator tube is supplied with heated fresh air from a preheating chamber in the front wall of the furnace which also keeps the front wall of the furnace at an acceptably low temperature as to avoid any danger to people in the vicinity of the furnace. The heating chamber in the front wall also substantially surrounds the access door through which logs are supplied into the burner so that the front door is also kept at an acceptably minimal temperature, thus permitting it to be opened for feeding the fire. Additional aspirator tubes adjacent the longitudinal side walls of the combustion chamber direct additional jets of heated secondary air above the log fire on the grates to add to the cyclonic turbulence and contribute to the complete combustion of gases and creosote before the combustion gases are allowed to escape from the combustion chamber.

The combustion chamber is provided with an elongate shape to accommodate logs which are in fireplace lengths rather than in stove wood lengths as has been commonly known. In one particular embodiment, logs of 18 to 20 inches in length are easily accommodated.

The flame from an oil burner is directed into the combustion chamber through the side wall at a location approximately midway along the length of the side wall. As a result of this location of the port through which the oil fired flame is injected into the fire chamber, the oil or gas fueled flame is directed approximately midway along the length of the logs lying in the combustion chamber. The oil fired flame directed into the combustion chamber creates a double cyclonic action in both ends of the elongate combustion chamber so that substantially identical combustion occurs throughout the entire combustion chamber, thus causing the entire logs to be ignited and burned simultaneously.

It should be recognized that, whereas it is not essential that the oil or gas fueled flame be used to supplement the heat provided from the wood fire in the burner, at all times, it may be desirable to supplement the heat provided from the wood fire by the oil or gas fueled fire when the demands for heat are more than can be supplied from the wood fueled fire. When the wood fueled fire is used in conjunction with the oil or gas fueled flame, combustion of the wood fueled fire is assisted, both as to intensity, and as to assuring that maximum burning of the logs in the burner or furnace is accomplished. In many instances, the heat provided from the wood fueled fire will be adequate.

DETAILED DESCRIPTION OF THE INVENTION

Figure 1:
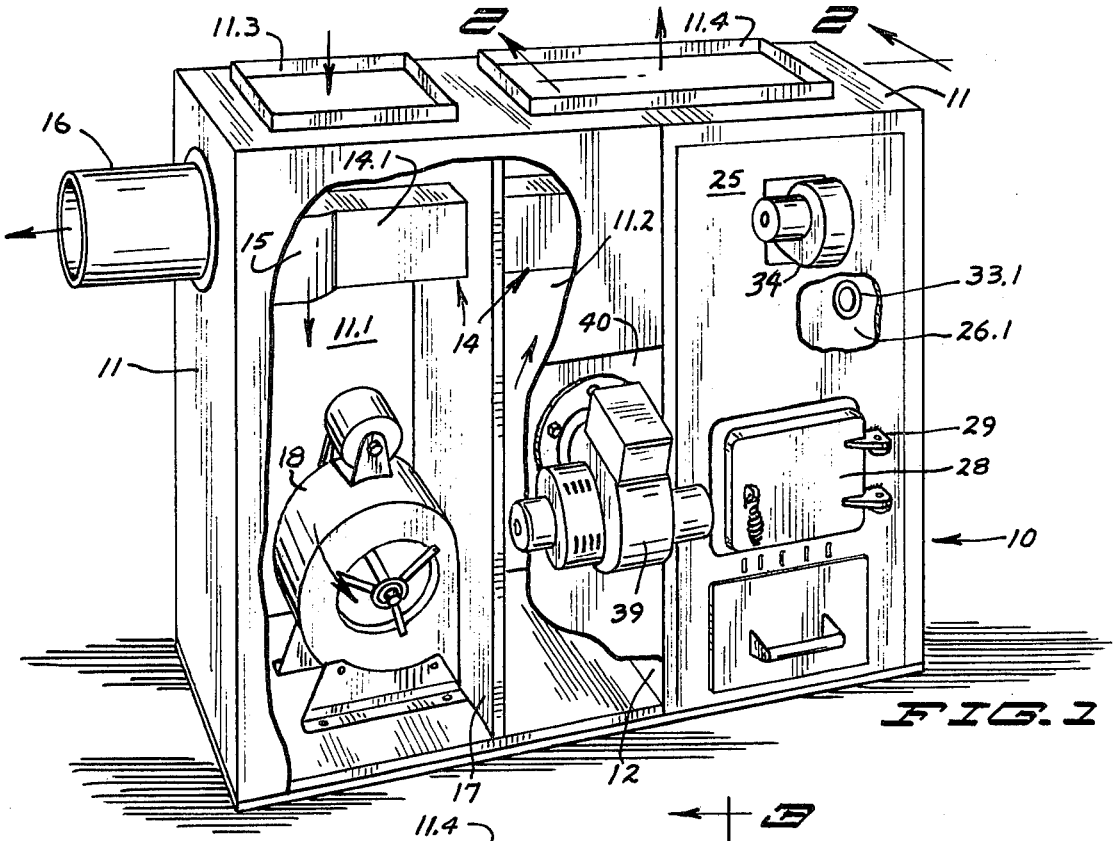
FIG. 1 is a perspective view of the furnace with portions of the paneling broken away for some clarity of detail.
Figure 2:
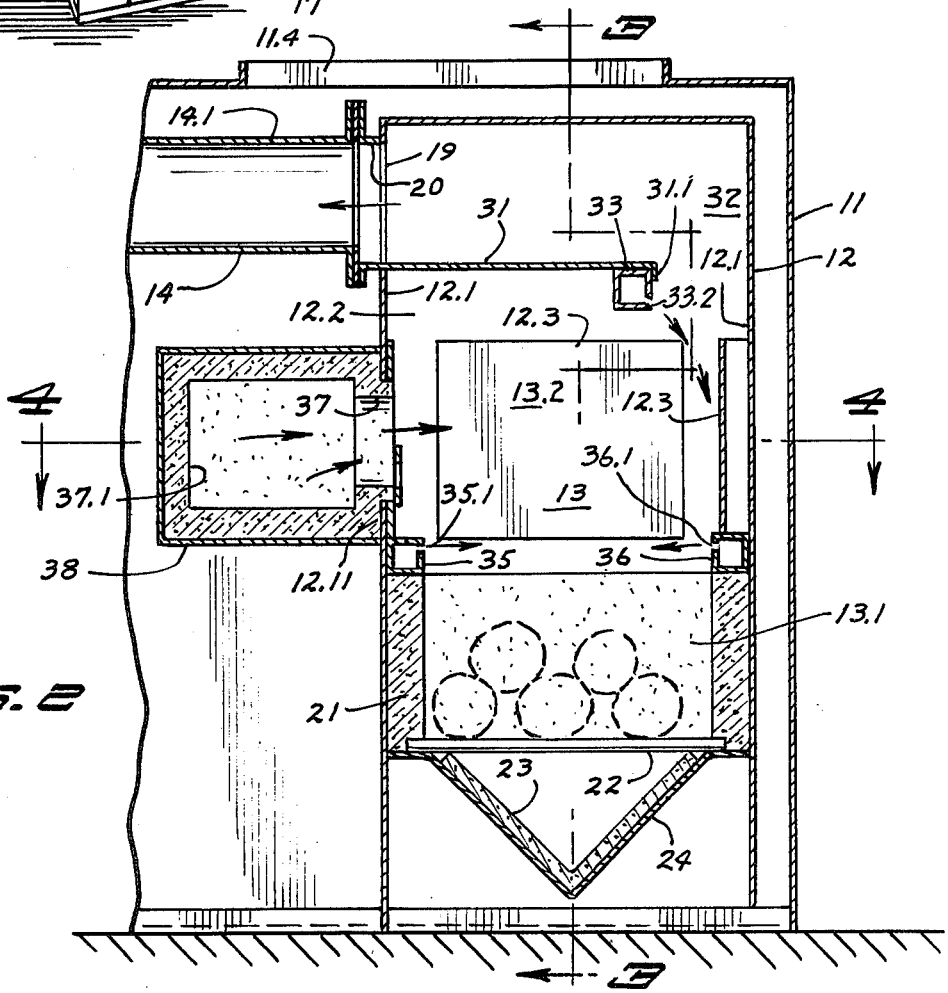
FIG. 2 is a transverse section view taken at 2—2 in FIG. 1.

One form of the invention is illustrated in the drawings and is described herein. The combined wood and oil burning furnace is illustrated in FIG. 1 and is indicated in general by numeral 10.

The furnace includes an outer shell or shroud 11 through which air is circulated to be heated and then directed back to the heating ducts of the building or space to be heated. Furnace 10 also includes an inner housing 12 which defines the combustion chamber 13. The furnace also includes a heat exchanger 14 which conducts the hot combustion gases from the housing 12 and through the interior spaces of the outer shell 11 and to a manifold 15 which collects all the combustion gases and discharges such gases to an outlet flue 16 for connection to a stack.

It will be recognized that the heat exchanger 14 comprises a plurality of rectangular metal ducts 14.1 which are generally rectangular in configuration and are spaced apart so that air may circulate all around the ducts 14.1 for maximum heat exchange. The outer shell or shroud 11 has an interior divider wall 17 which divides the interior of the outer shell 11 into an intake or preheating compartment 11.1 and a second heating compartment 11.2 which completely surrounds the inner housing 12.

The shell or shroud 11 has an air intake opening 11.3, adapted for connection to the air return ducts of a building heating system for delivering air to the furnace to be heated. The air traverses a portion of the heat exchanger 14 which is in the chamber 11.1, and proceeds to a fan 18 which propels the air through the wall 17 and into the heating chamber 11.2. The air in the heating chamber 11.2 circulates around the outer periphery of the inner housing 12 and also through the heat exchanger 14 in the chamber 11.2 and thence is moved outwardly through the air discharge opening 11.4 which is adapted for connection to the hot air delivery ducts in the heating system of a building.

The combustion chamber 13 of the inner housing 12 has a lower portion 13.1 defining a fire pit and an upper portion 13.2 in which combustible gases and particles are substantially consumed before being allowed to exit from the combustion chamber.

The upper portion of the housing 12 has a large discharge opening 19 through which combustion gases are directed into a manifold or discharge plenum 20 which is connected to the heat exchanger 14.

The lower portion 13.1 of the combustion chamber is lined with fire brick 21 at the two longitudinal sides and across the rear or back side. This lower portion or fire pit of the combustion chamber confines the logs L which are placed in the fire chamber for burning. The lower portion of the housing has horizontal grates 22 forming the bottom of the fire pit. The grates are laid on shoulder portions of the housing structure and are spaced apart to allow ashes to fall between the grates. A removable ash drawer 23 is V-shaped and rests upon a V-shaped panel 24 forming a part of the housing.

The drawer 23 has a front panel 23.1 with a handle 23.2 affixed thereon. The front panel of the drawer and the handle lies substantially flush with the outer panel 25 of the hollow or chambered front wall 26 of the housing 12. As appears in FIG. 1, the front panel 25 lies substantially flush with the adjacent portions of the outer shell 11 of the furnace.

The hollow or chambered front wall 26 of the housing 12 has a charging or access opening 27 formed therethrough and which is normally closed by an access or fire door 28, which is mounted on hinges 29. An inner panel 30 of the chambered wall 26 cooperates with the outer panel 25 in defining a preheating chamber 26.1 which extends all across the width of the housing 12 above the access opening 27, and extends downwardly along both sides of the access opening 27 approximately to the bottom of the access opening 27 and door 28. The metal plate 30 transmits heat from the combustion chamber 13 to the air in the preheating chamber 26.1 so that the air therein is heated.

The front wall 26 also defines a passage 26.2 for draft air which enters through a draft opening 25.1 in the outer panel 25 and which may be controlled by a regulator valve. The draft passage 26.2 is defined by a lower portion 30.1 of the inner panel which defines a draft air opening 30.2 through which the draft air is directed into the fire pit adjacent the grates 22.

In the upper portion 13.2 of the combustion chamber, the side walls 12.1 and back wall 12.2 are protected from intense heat by auxiliary panels 12.3 which are spaced inwardly.

A generally horizontal baffle plate 31 traverses a substantial portion of the upper interior of the combustion chamber and is secured to one of the longitudinal side walls 12.1 adjacent the outlet opening 19. The baffle 31 is also affixed to the rear wall 12.2 of the housing and to the inner panel 30 of the chambered front wall 26. The free edge 31.1 of the baffle 31 is spaced from the adjacent side wall of the housing to define a combustion gases discharge passage 32 through which all of the combustion gases, moisture and air must pass as they travel from the upper portion 13.2 of the combustion chamber to the outlet 19.

An array or curtain of adjacent jets or streams of preheated secondary air are directed across the passage 32 from an air supply or aspirator tube 33 which extends along the free edge 31.1 of the baffle throughout substantially the entire length of the elongate fire chamber 13. The air tube 33 has its front end communicating with the preheating air chamber 26.1 through an opening 33.1 in the inner panel 30 of the chambered wall 26 to receive air under pressure. The tube 33 has a plurality of discharge openings or apertures 33.2 which direct streams or jets of the air from tube 33 transversely across the discharge passage 32 through which all of the combustion gases must flow. The streams or jets of air are directed obliquely downwardly and toward the adjacent longitudinal side wall of the inner housing 12 so as to thoroughly expose all of the combustion gases passing through the passage 32 to fresh heated air for completing combustion and also for creating a cyclonic turbulence.

Air is supplied into the preheating chamber 26.1 by a fan 34 mounted on the front panel 25 of the chambered wall 26. Air from the fan is moved through the preheating chamber 26.1 and into the tube 33.

Figures 3, 4:
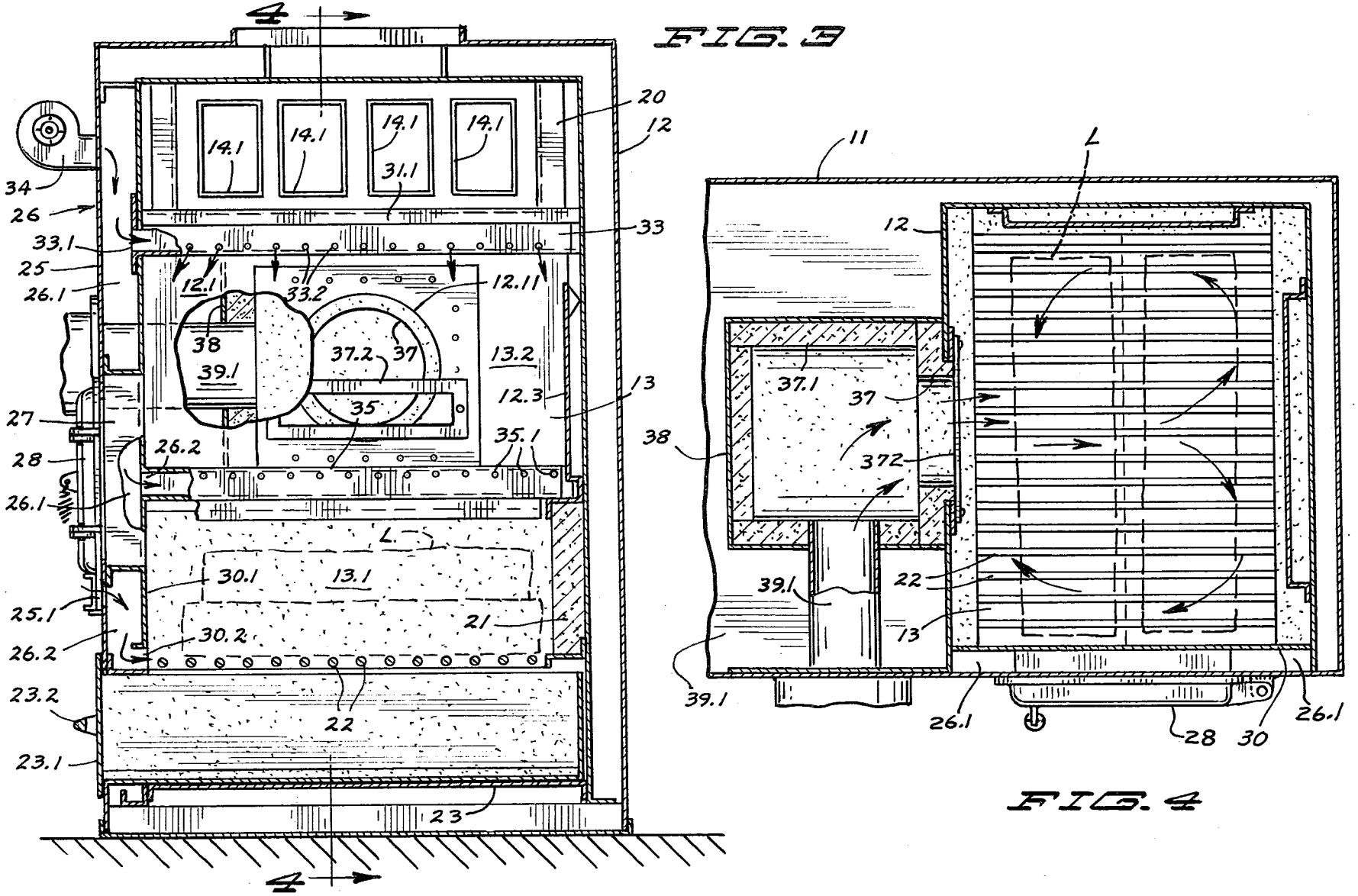
FIG. 3 is a longitudinal section view taken approximately at 3—3 in FIG. 2.
FIG. 4 is a horizontal view taken at 4—4 in FIG. 3.

A pair of additional air supply or aspirator tubes 35 and 36 are respectively located along the opposite longitudinal side walls of the combustion chamber and immediately above the fire brick 21 which defines the fire pit 13.1. The tubes 35 and 36 have discharge apertures 35.1 and 36.1, respectively, which are oriented to direct air horizontally outwardly away from the adjacent side wall and substantially horizontally into the central area of the combustion chamber. Secondary air is thereby provided which sweeps across the top of the fire pit and of the logs and burning material therein. Air supply tubes 35 and 36 are both connected to the air preheating chamber 26.1 in the manner illustrated in relation to tube 35 in FIG. 3. The portions of the preheating chamber 26.1 which extend downwardly along the side edges of the access opening 27 have openings 26.2 through the inner panel so as to direct air into the two tubes 35 and 36.

One of the longitudinal side walls 12.1 of the combustion chamber has a large burner port 12.11 therein. A fire brick liner 37 is provided for the port, and an auxiliary burner chamber 38 is mounted at an exterior location with respect to the housing 12, but within the shell 11 to surround the fire brick lined opening. The auxiliary chamber 38 is lined with fire brick 37.1. An oil burner 39 is mounted on a front panel 40 which lies flush with the outer panel 25 of the chambered front wall 26 and flush with the remainder of the outer shell 11. The oil burner 39 is connected into the auxiliary chamber 38 through a duct 39.1. A guard bar 37.2 traverses the opening in the housing side wall to prevent debris from being accidentally inserted into the auxiliary chamber 38.

The usual type of thermostats are provided for controlling the functions of the furnace 10. A thermostat may be provided within the outer shell 11, and in the vicinity of outlet 11.4 for assuring that when the temperature within the shell 11 drops to a first level such as 180°, the fan 34 will always be turned back on, and if the room thermostat is calling for heat, the oil burner 39 will also be turned on; and such thermostat being also for the purpose of turning both the fan 34 and oil burner 39 off when temperatures in the shell 11 reach another temperature level, such as 200°; and an additional thermostat in the furnace will turn the furnace fan 18 to full speed whenever the temperature in the shell 11 rises to a third temperature level such as 140°; and as to reduce the speed of fan 18 to half speed when the temperature in the shell reaches a fourth temperature level such as 100°. These are conventional and well known thermostatic controls and, except for the control of the fan 34, comprise no portion of the present invention.

In normal operation of the furnace 10, the furnace may be operated almost entirely on wood fuel, or may be operated only minimally on wood fuel, according to the desires and plans of the person utilizing the furnace.

Green or seasoned logs L will be placed in the fire pit on the grates for burning and as to increase the heating effect of the furnace. In practically all circumstances, when a wood fire is burning in the fire pit, the fan 34 will be turned on, and preheated air from chamber 26.1 is being blown through tubes 33, 35 and 36. In the combustion of logs L in the fire pit, a substantial quantity of combustion gases including methane gas, moisture in the form of vapor, and creosote in small particles or vapor form are driven off the logs by the heat of the fire and exist in the upper portion of the combustion chamber. The preheated secondary air which is directed out of the tubes 33, 35 and 36 produces a substantial cyclonic turbulence in the upper portion of the combustion chamber and over the logs L in the fire pit so that air and oxygen is adequate to promptly burn all of the volatiles and combustibles which are carried in the combustion gases. Air is supplied under the logs to provide primary combustion air, but the swirling turbulence in the upper portion of the combustion chamber produces the thorough burning of the various combustibles, both in gaseous form and in particlized form. When the combustibles are ultimately driven toward the outlet 19 and the heat exchanger 14, the combustion gases must pass through the rather elongate and narrow passage 32, and at this time the combustion gases are subjected to the array or curtain of incoming heated secondary combustion air so that an adequate supply of oxygen is provided for completing the final combustion of any gases that move upwardly toward the outlet 19. This array of air streams or jets in a curtainlike arrangement is directed obliquely downwardly so that the entire quantity of combustion gases in the upper portion 13.2 of the combustion chamber revolves downwardly and then upwardly across the port 12.11. As a result of the substantially complete combustion of all the combustibles from the log fueled fire, there will be no discernible collection of creosote or other solid materials in the ducts of the heat exchanger or in the flue or stack.

It may be desirable when burning green wood or wood that is freshly cut and is likely to contain a substantial amount of creosote and moisture, to add supplementary heat from the oil burner 39. When the oil burner is turned on or energized, the burning fluid particles are injected into the combustion chamber from the auxiliary chamber 38 at a location approximately midway along the length of the combustion chamber and midway along the length of the logs lying in the fire pit. This injection of the burning fluid fueled fire into the combustion chamber produces a double cyclonic action throughout the entire combustion chamber so that the heat of combustion from the fluid fueled fire is applied to substantially all portions of the length of the logs L contained in the fire pit. As a result, the entire logs L will be burning substantially simultaneously. As the stream of fluid fueled fire is injected from the auxiliary chamber 38 and through the port 12.11 in the side wall, the streams or jets of air from the air or aspirator tube 33 cause the stream of fluid fueled fire from the oil burner to be tipped or inclined downwardly so that this stream of fire is directed downwardly into the fire pit. This downward inclination by reason of the air jets or streams from the tube 33 contributes materially to the turbulence of the combustion gases in the fire pit and contributes materially to the complete combustion of all of the combustible gases in the chamber 13.

It will be recognized that when the combustion gases pass through the heat exchanger 14, the air in the furnace is circulated from the intake opening 11.3 downwardly through the cooler portion of the heat exchanger 14 and thence through fan 18 and chamber 11.2 to and through the portion of heat exchanger which is closest to the inner housing 12, and therefore the hottest portion. From there the circulating air is discharged from the opening 11.4 for circulation back to the space that is being heated. It will be seen that I have provided a new and improved wood and oil burning furnace providing for efficient combustion of all of the combustibles in the wood fueled fire.

Preheated secondary air is injected into the upper portion of the combustion chamber in an array of jets or air streams in a curtainlike arrangement across the outlet passage so that all of the combustion gases are subjected to sufficient oxygen to complete their combustion. Three separate air tubes in the combustion chamber produce a swirling and turbulence in a cyclonic action with all of the combustible gases so that such combustibles are entirely consumed in the furnace. An auxiliary oil burner supplies additional fluid fueled fire into the combustion chamber at a location midway along the longitudinal sides of the combustion chamber so that heat of combustion is directed, in a cyclonic turbulence, to all portions of the logs lying in the fire pit and particularly to the opposite ends wherein oppositely directed cyclonic turbulence is produced. It should be understood that the fluid fueled fire is produced in this illustrated form by an oil burner, but the auxiliary heat could as well be supplied by other fluid fuels such as natural gas, bottle gas, or the like.

What I claim is:

1. A furnace for burning both wood logs and fluid fuel, comprising:

enclosure means defining an elongate combustion chamber including a lower portion defining a fire pit to confine fuel logs during burning thereof, and also including an upper portion in which gas-carried combustibles may be burned, there being a combustion gases outlet adjacent the top of the chamber;

the enclosure means also having an elongate side wall extending along the elongate combustion chamber, there being an entrance port through said side wall and located midway between the ends of the combustion chamber and adjacent the upper portion of the combustion chamber;

a baffle plate extending the full length of the combustion chamber and generally horizontally outwardly from said wall and across a significant portion of the combustion chamber at a location well above the entrance port, said baffle plate having an edge cooperating with the enclosure means to define an elongate combustion gases discharge passage across from and above the entrance port;

a fluid fuel fired burner and a mounting therefor and directing a fluid fueled flame through said entrance port and in a direction transversely across the upper portion of said combustion chamber and intermediate the ends thereof;

an elongate and linear air supply and distributing tube in the upper portion of the combustion chamber and above said entrance port, said tube extending along and closely adjacent the edge of the baffle plate and extending longitudinally of the combustion chamber and substantially from front to back thereof, said tube having a plurality of air discharge ports along its length and oriented and directing air downwardly and away from said entrance port and transversely across said discharge passage to supply combustion air to all of the gases traversing the discharge passage and to cooperate with said fluid fueled flame from the burner in producing cyclonic turbulence at both ends of the combustion chamber and downwardly into the fire pit for inducing accelerated burning of the logs in the fire pit and complete combustion of the gas-carried combustibles in the upper portion of the combustion chamber; and means inducing flow of air in the supply tube.

2. The invention according to claim 1 and including means of preheating the air supplied to said supply tube and utilizing heat from combustion in the combustion chamber for preheating such air.

3. A furnace for burning both wood logs and fluid fuel, comprising:

enclosure means defining an elongate combustion chamber including a lower portion defining a fire pit to confine fuel logs during burning thereof, and also including an upper portion in which gas-carried combustibles may be burned, there being a combustion gases outlet adjacent the top of the chamber the enclosure means also having an elongate side wall extending along the elongate combustion chamber, there being an entrance port through said side wall and located intermediate the ends thereof and adjacent the upper portion of the combustion chamber;

a fluid fuel fired burner and a mounting therefor and directing a fluid fueled flame through said entrance port and in a direction transversely across the upper portion of said combustion chamber and intermediate the ends thereof;

an elongate air supply and distributing tube in the upper portion of the combustion chamber and above said entrance port, said tube having a plurality of air discharge ports along its length and oriented and directing air downwardly and away from said entrance port to cooperate with said fluid fueled flame from the burner in producing cyclonic turbulence at both ends of the combustion chamber and downwardly into the fire pit for inducing accelerated burning of the logs in the fire pit and complete combustion of the gas-carried combustibles in the upper portion of the combustion chamber;

means inducing flow of air in the supply tube;

a baffle plate extending the full length of the combustion chamber and generally horizontally outwardly from said wall and across a significant portion of the combustion chamber, said baffle plate having an edge cooperating with the enclosure means to define a combustion gases discharge passage, and the edge of said plate being disposed adjacent said air supply tube, said tube directing air from said discharge ports transversely across said passage to supply combustion air to all of the gases traversing said passage; and two additional elongate air supply tubes respectively disposed at opposite sides of the combustion chamber and extending longitudinally thereof throughout substantially the entire length of the elongate combustion chamber and adjacent the upper edge of the fire pit, said additional tubes directing air transversely across the combustion chamber and contributing secondary air and turbulence within the combustion chamber.

* * * * *